US007427724B2

(12) United States Patent
Rochon et al.

(10) Patent No.: US 7,427,724 B2
(45) Date of Patent: Sep. 23, 2008

(54) ILLUMINATED ELECTRICAL SWITCH WITH A TACTILE EFFECT

(75) Inventors: Sylvain Rochon, Dole (FR); Jeremy Hebras, Athee (FR); Lourent Bouvier, Nibbueres (FR); Aurelien Carvalho, La Vielle Loye (FR)

(73) Assignee: CoActive Technologies, Inc., Greenwich, CT (US)

( * ) Notice: Subject to any disclaimer, the term of this patent is extended or adjusted under 35 U.S.C. 154(b) by 203 days.

(21) Appl. No.: 11/442,495

(22) Filed: May 25, 2006

(65) Prior Publication Data

US 2006/0278515 A1 Dec. 14, 2006

Related U.S. Application Data

(63) Continuation-in-part of application No. PCT/EP2004/053417, filed on Dec. 13, 2004.

(51) Int. Cl.
*H01H 13/81* (2006.01)

(52) U.S. Cl. ..... 200/406; 200/314; 200/521

(58) Field of Classification Search ..... None
See application file for complete search history.

(56) References Cited

U.S. PATENT DOCUMENTS

| | | | | |
|---|---|---|---|---|
| 6,310,308 | B1 | 10/2001 | Watson et al. | |
| 6,323,449 | B1 * | 11/2001 | Janniere | 200/317 |
| 6,756,554 | B1 * | 6/2004 | Hu | 200/533 |
| 7,202,429 | B2 * | 4/2007 | Bouvier et al. | 200/314 |
| 7,235,754 | B2 * | 6/2007 | Rochon et al. | 200/314 |

FOREIGN PATENT DOCUMENTS

| | | |
|---|---|---|
| FR | 2 503 446 | 10/1982 |
| JP | 05 041132 | 2/1993 |
| JP | 07 065666 | 3/1995 |

* cited by examiner

*Primary Examiner*—Renee S Luebke
(74) *Attorney, Agent, or Firm*—Pepper Hamilton LLP

(57) ABSTRACT

An invention proposes a switch comprising a lower casing in the bottom of which are placed two contact elements. A trip member is elastically deformable through the action of an actuating member. At least one light source is supported by a support plate which straddles the actuating member and has terminals for electrical connection of the light source. The lower face of the support plate rests on the lower casing. The electrical connection terminals of the light source extend outwards from the casing along the vertical lateral faces of the casing.

8 Claims, 17 Drawing Sheets

ILLUMINATED ELECTRICAL SWITCH WITH A TACTILE EFFECT

CROSS-REFERENCE TO RELATED APPLICATION

This is a Continuation-In-Part of PCT/EP2004/053417 filed Dec. 13, 2004 which designated the US, and which claimed priority from French patent application No. 0315611 filed Dec. 31, 2003.

BACKGROUND OF THE INVENTION

The present invention relates to an electrical switch with a tactile effect, and to an electrical switch of the luminous or illuminated type which is especially used in large quantities for equipping motor vehicles. The invention relates to such a switch comprising:

- a lower casing, the lower face of which is designed to rest on the upper face of a printed-circuit board, which lower casing defines an internal cavity in the bottom of which are placed at least two fixed electrical contact elements, each of which is connected to a connection tab that projects to the outside of the casing for the electrical connection of the fixed contact element to a conducting track on the printed-circuit board;
- a trip member of domed general shape, which is housed in the cavity and is elastically deformable, from a stable rest state, under the action of an actuating member, the lower part of which acts on the trip member along a direction approximately perpendicular to the bottom of the cavity; and
- at least one light source carried by a support plate which extends horizontally above the open upper face of the cavity, which straddles the actuating member and which includes terminals for electrical connection of the light source to a power supply circuit for the light source, especially one controlled by the switch.

The action of the actuating member on the trip member establishes an electrical connection between the two fixed contacts for the purpose of supplying electrical power to the light source, which is connected to a power supply circuit controlled by the switch.

An example of such a type of switch is described and illustrated in Document JP-A-7.65.666 in which the support plate for the light source, which for example is made in the form of a light-emitting diode or LED, is integrated into the switch with the electrical connection terminals of the light source, which extend through the bottom of the lower casing.

Such a design has various drawbacks.

Firstly, in order to mount and connect the electrical switch and the electrical connection terminals of the LED, it has to use the technique of inserting leads into the printed-circuit board.

In addition, it allows no modularity in the switch design, especially as regards the use of various light sources and/or the electrical connection and supply circuits for the light sources.

SUMMARY OF THE INVENTION

To remedy these drawbacks in particular, the invention proposes an electrical switch of the abovementioned type, characterized in that the electrical connection terminals of the light source extend vertically to the outside of the casing along vertical lateral faces of the casing.

According to other features of the invention:

- the lower face of the support plate rests on one edge of the lower casing;
- the casing has two vertical, parallel and opposed, side walls, the upper edges of which each have an upwardly open housing that houses a facing portion of the support plate;
- the switch includes an attached cage for fastening the support plate to the casing;
- the fastening cage is a metal cage comprising an upper closure frame that extends opposite the upper edges of the side walls of the casing and having vertical arms for fastening the frame to the casing;
- the closure frame bears vertically on the upper edges of the side walls of the casing;
- the upper closure frame also provides the positioning and upward vertical retention of the support plate;
- the lower free ends of the electrical connection terminals of the light source are shaped so as to bear elastically on conducting tracks on the upper face of the said printed-circuit board; and
- the support plate delimits, vertically upwards, the rest position of the trip member to which rest position it is elastically returned.

Other features and advantages of the invention will become apparent on reading the detailed description that follows of a preferred embodiment of an electrical switch according to the teachings of the invention, for the understanding of which reference will be made to the appended drawings.

DESCRIPTION OF THE PREFERRED EMBODIMENT

In the description that follows, in order to make it and the claims easier to understand, the terms "lower", "longitudinal", "transverse" and "vertical" will be used, in a non-limiting manner, with reference to the general orientation of the figures and to the coordinate system LVT indicated in the figures.

Identical, analogous or similar components will be denoted by the same reference numbers.

Figure 11:
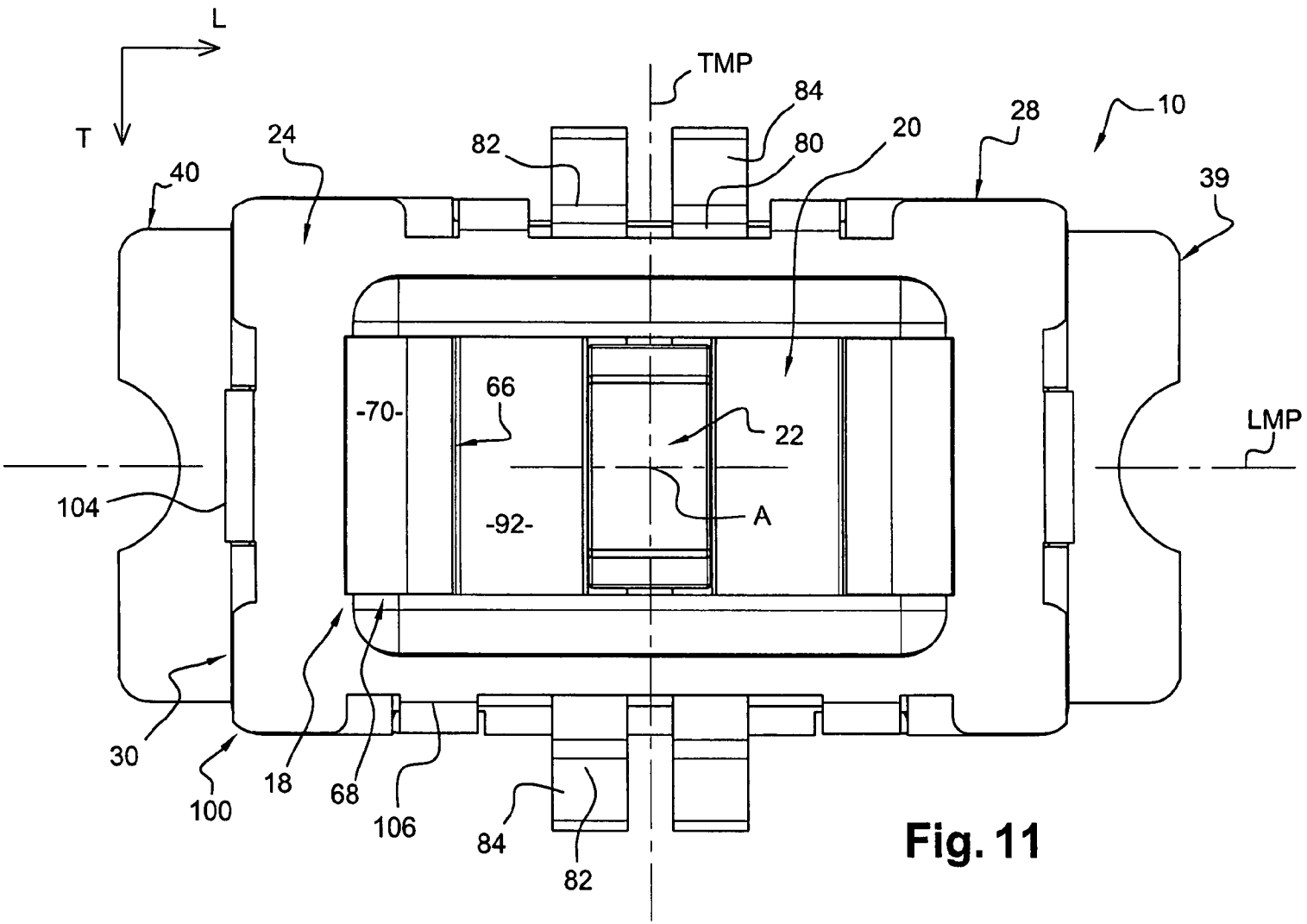
FIG. 11 is a top view on a large scale of the switch of FIG. 1.
Figure 12:
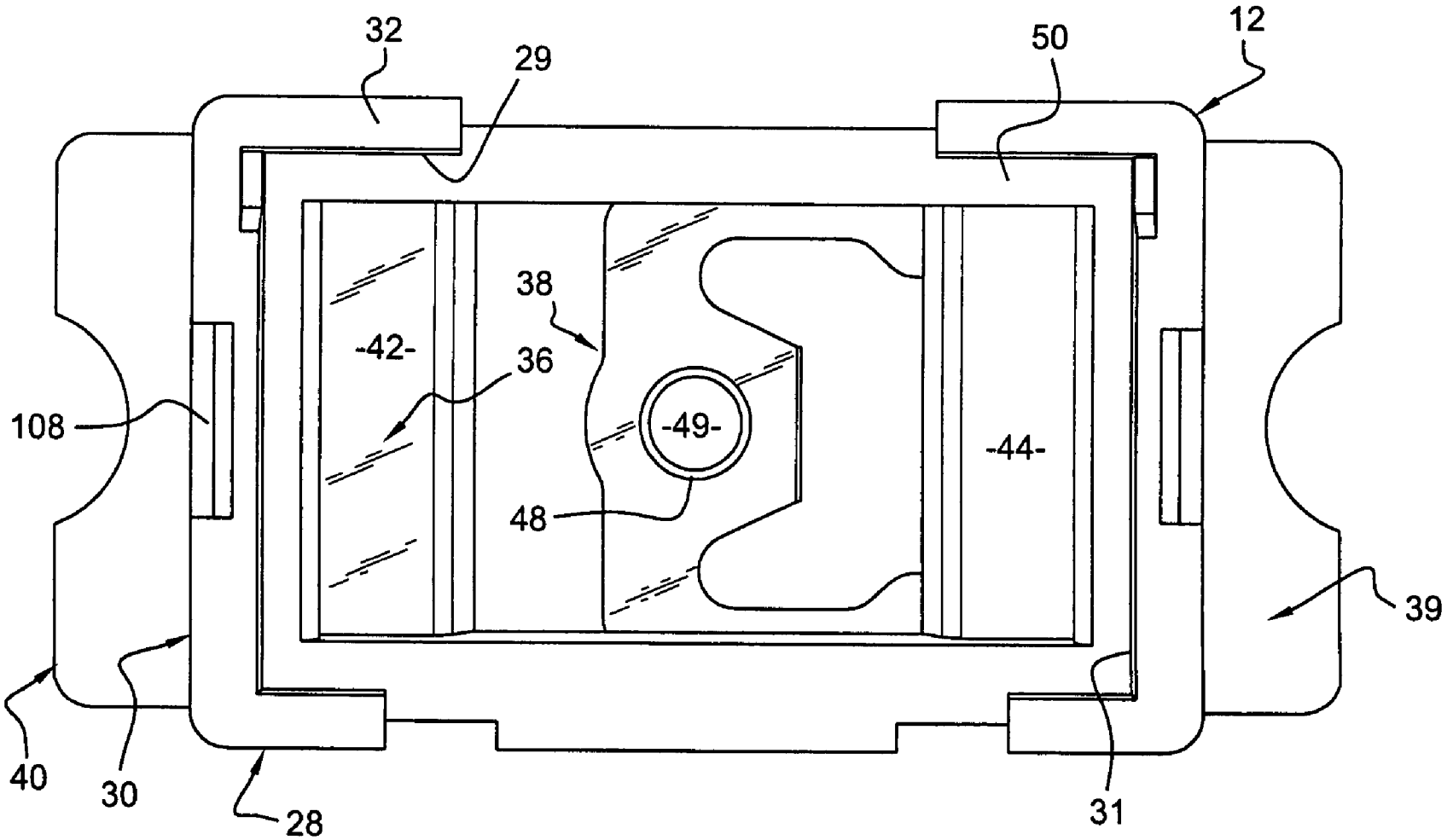
FIG. 12 is a top view on a large scale of the lower casing of the switch illustrated in perspective in FIG. 10.
Figure 13:
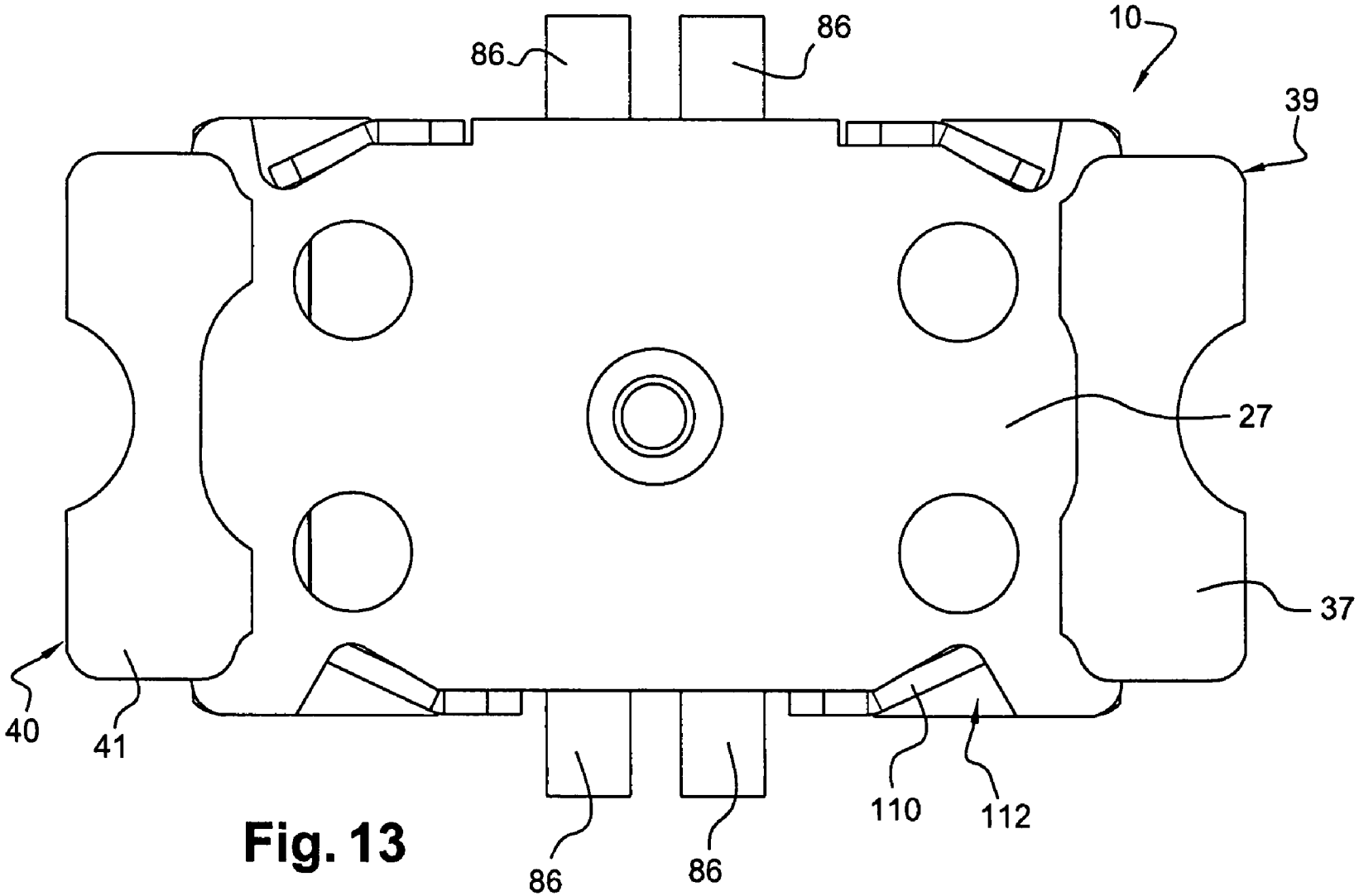
FIG. 13 is a bottom view of the switch of FIG. 11.

The switch 10 illustrated in the figures exhibits a double general design symmetry relative to the vertical longitudinal mid-plane LMP and the vertical transverse mid-plane TMP indicated in FIG. 11, these planes intersecting on the vertical central axis A.

The switch 10 essentially comprises, stacked vertically upwards along the vertical central axis A, the lower casing 12, two superposed trip members 14, two superposed flexible sealing films 16, an actuating member or actuator 18, a horizontal support plate 20 of a light-emitting diode or LED 22, and an upper cage 24 for closing off and fastening the components.

Figure 10:
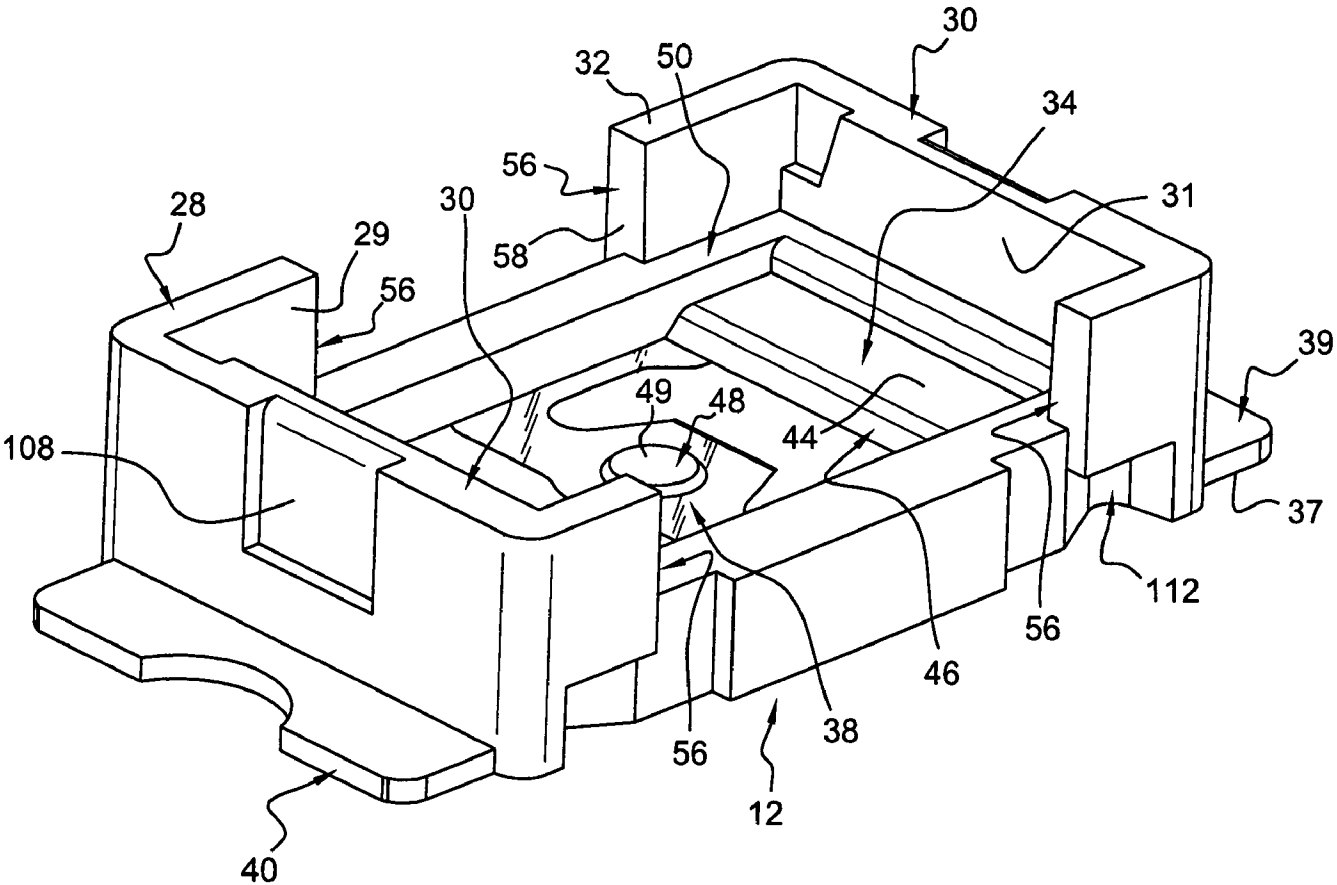

As may be seen especially in FIG. 10, the lower casing 12 is a hollow part of rectangular parallelepipedal general shape, this part being produced by overmoulding with an insulating plastic.

The casing 12 comprises a lower horizontal bottom plate 26 bounded by a lower face 27, from which plate 26 there extend, vertically upwards, two longitudinal vertical side walls 28 and two transverse vertical side walls 30 that are bounded vertically upwards by an upper face or horizontal edge 32.

The opposed internal faces 29 of the longitudinal walls 28 and 31 of the transverse walls 30, define an internal central cavity 34 in which various components of the switch 10 are placed.

The bottom plate 26 is overmoulded, in a known manner, over two conducting, cut and folded, metal parts, namely a lateral part 36 and a central part 38.

The fixed lateral contact 36 is extended longitudinally to the outside of the casing, beyond the external face of the left-hand transverse wall 30 when considering the figures, by a longitudinal electrical connection tab 40, the horizontal lower face 41 of which is coplanar with the lower face 27 of the bottom plate 26.

Like the lateral contact 36, the central contact 38 is extended longitudinally to the outside of the casing 12, beyond the external face of the right-hand transverse wall 30, by a contact plate 39, the horizontal lower face 37 of which is flush and coplanar with the lower face 27 of the bottom plate 26.

The horizontal upper face 42 of the fixed contact 36 extends into the bottom of the cavity 34, being offset vertically above the upper face 25 of the bottom plate 26 and at the same height as the horizontal upper face 44 of an overthickness 46 made by moulding with the bottom plate 26 of insulating material.

The fixed central contact 38 comprises a central disc 48, the conducting horizontal upper face 49 of which is at a greater height than that of the face 25 of the plate 26, but it is vertically offset downwards with respect to the horizontal plane passing through the upper face 42 of the fixed contact 36 and through the insulating horizontal face 44.

Above the horizontal plane H of the faces 42 and 44, the cavity 34 has a peripheral annular bottom 50 of rectangular outline.

As is known, the two trip members with a tactile effect 14 are identical superposed elements made of conducting material having the general shape of a rectangular pyramid with a central dome 52.

Figure 1:
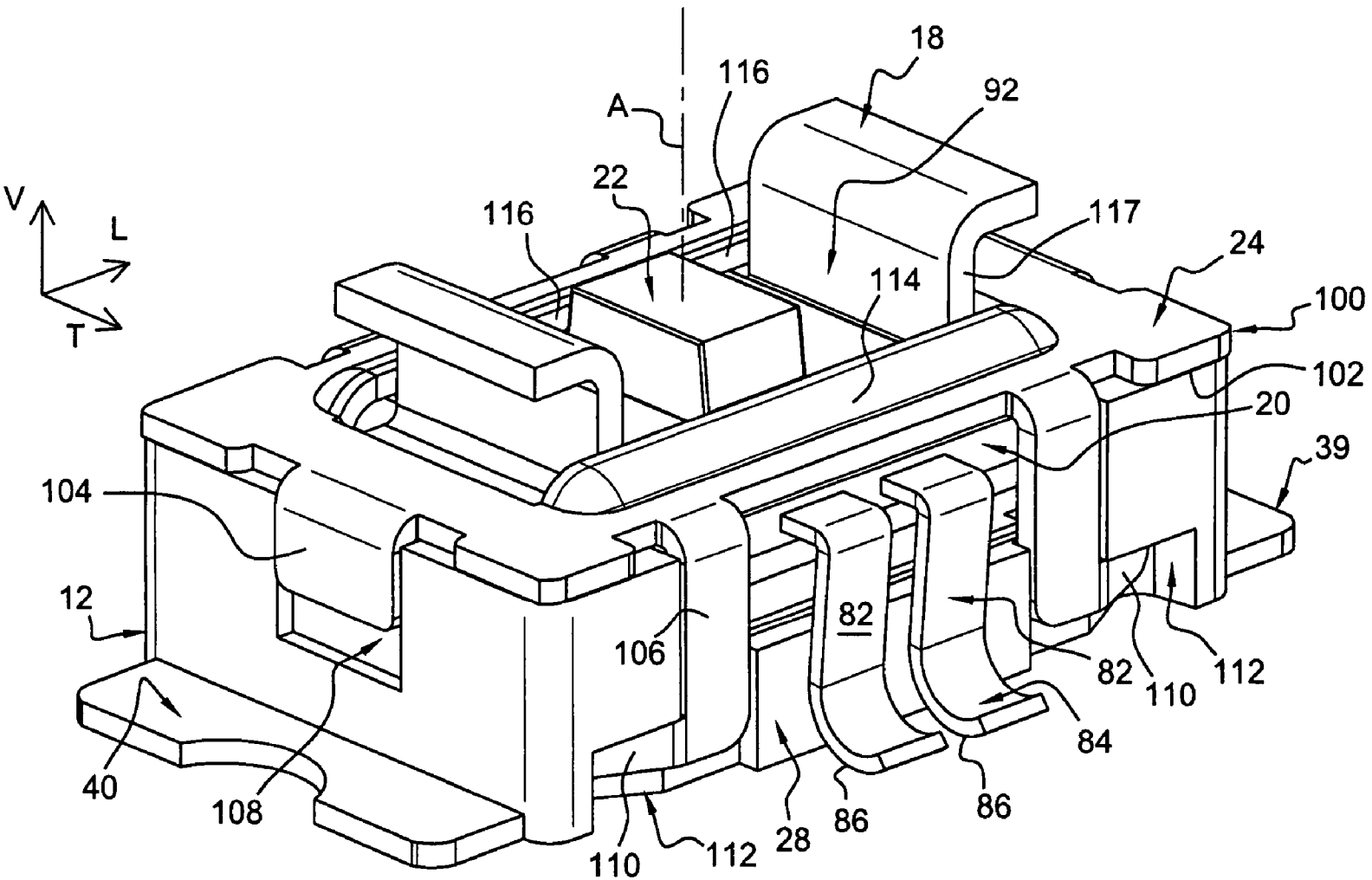
FIG. 1 is a top three-quarter isometric view on a large scale of the electrical switch.
Figure 2:
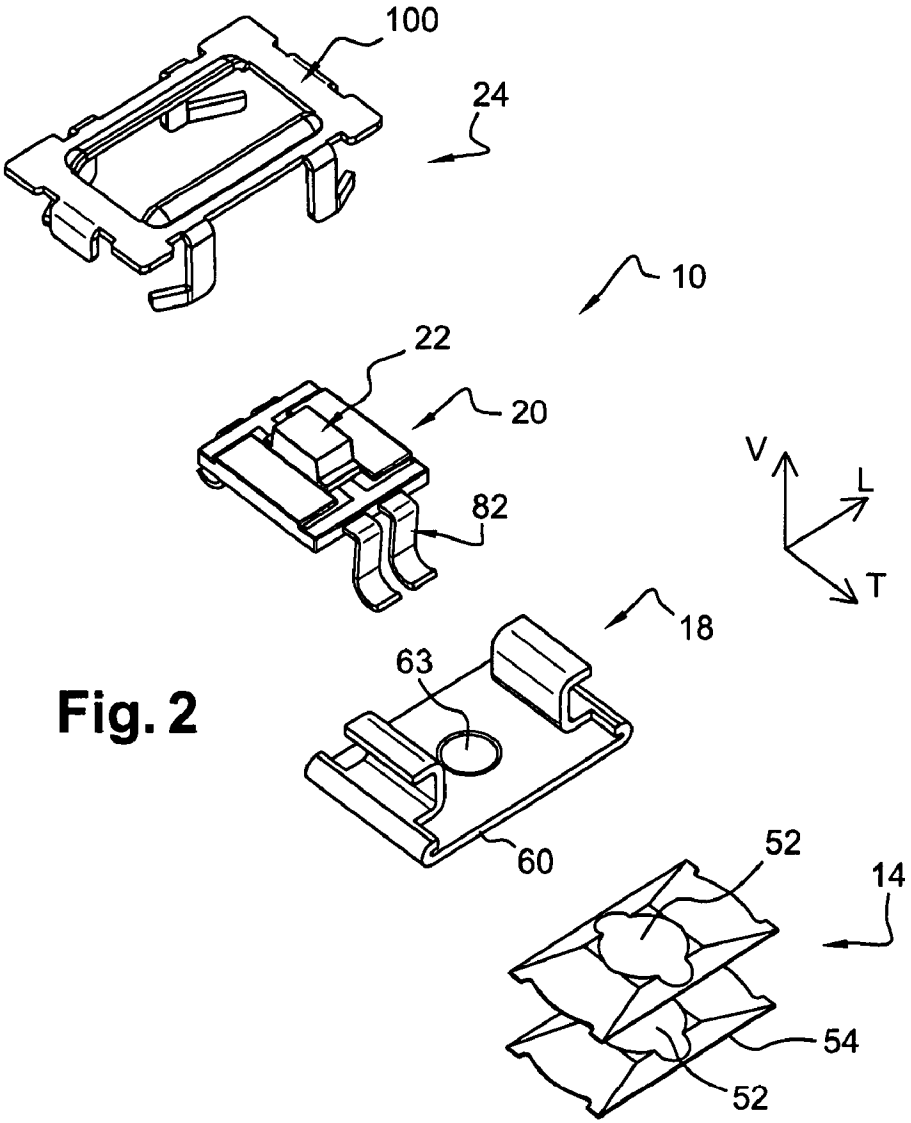
FIG. 2 is an exploded isometric view, at the same angle as that of FIG. 1, of the main components of the electrical switch.
Figure 3:
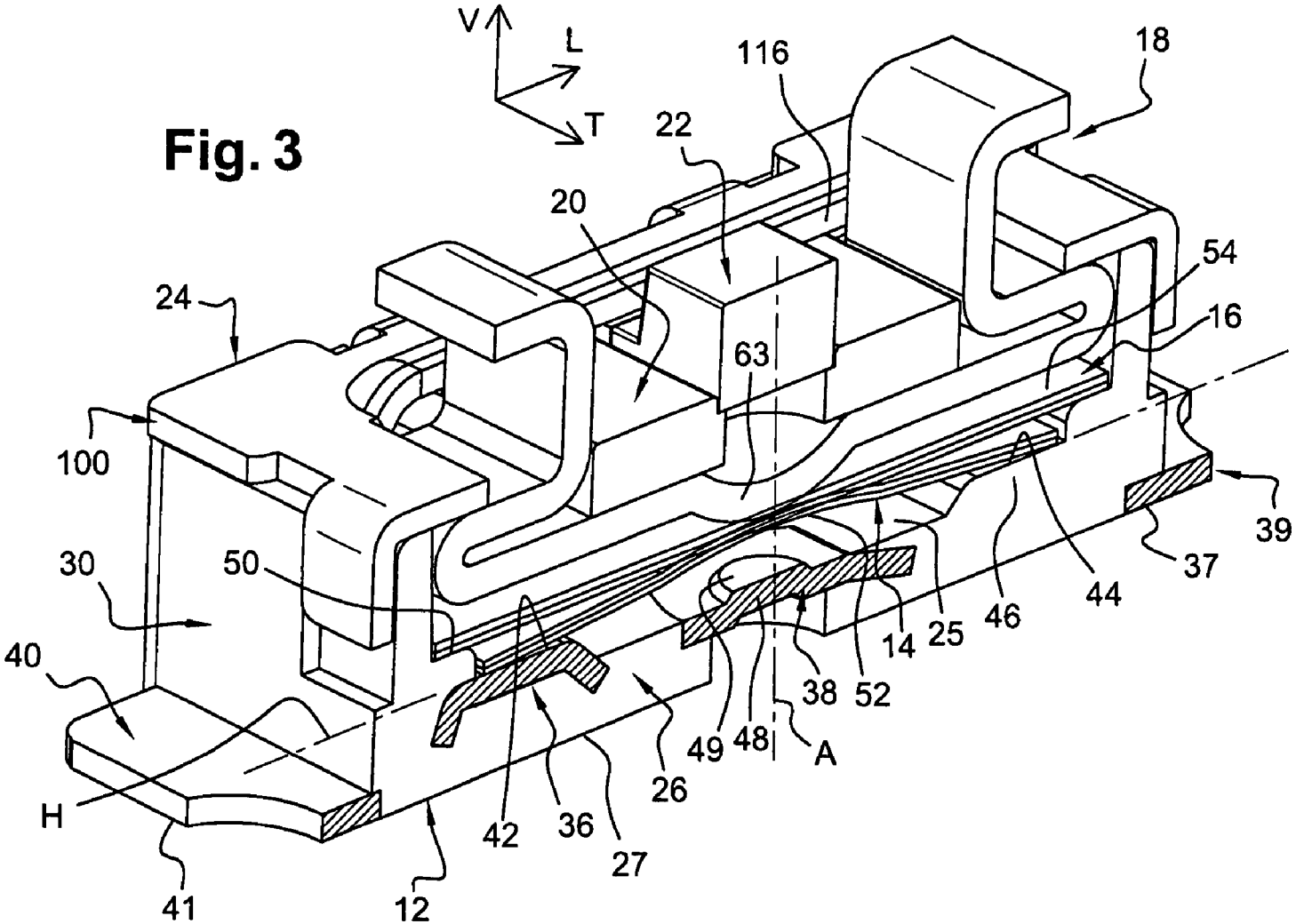
FIG. 3 is an isometric view similar to that of FIG. 1, in which the switch is shown in section on the vertical longitudinal mid-plane (LMP) of FIG. 11.
Figure 4:
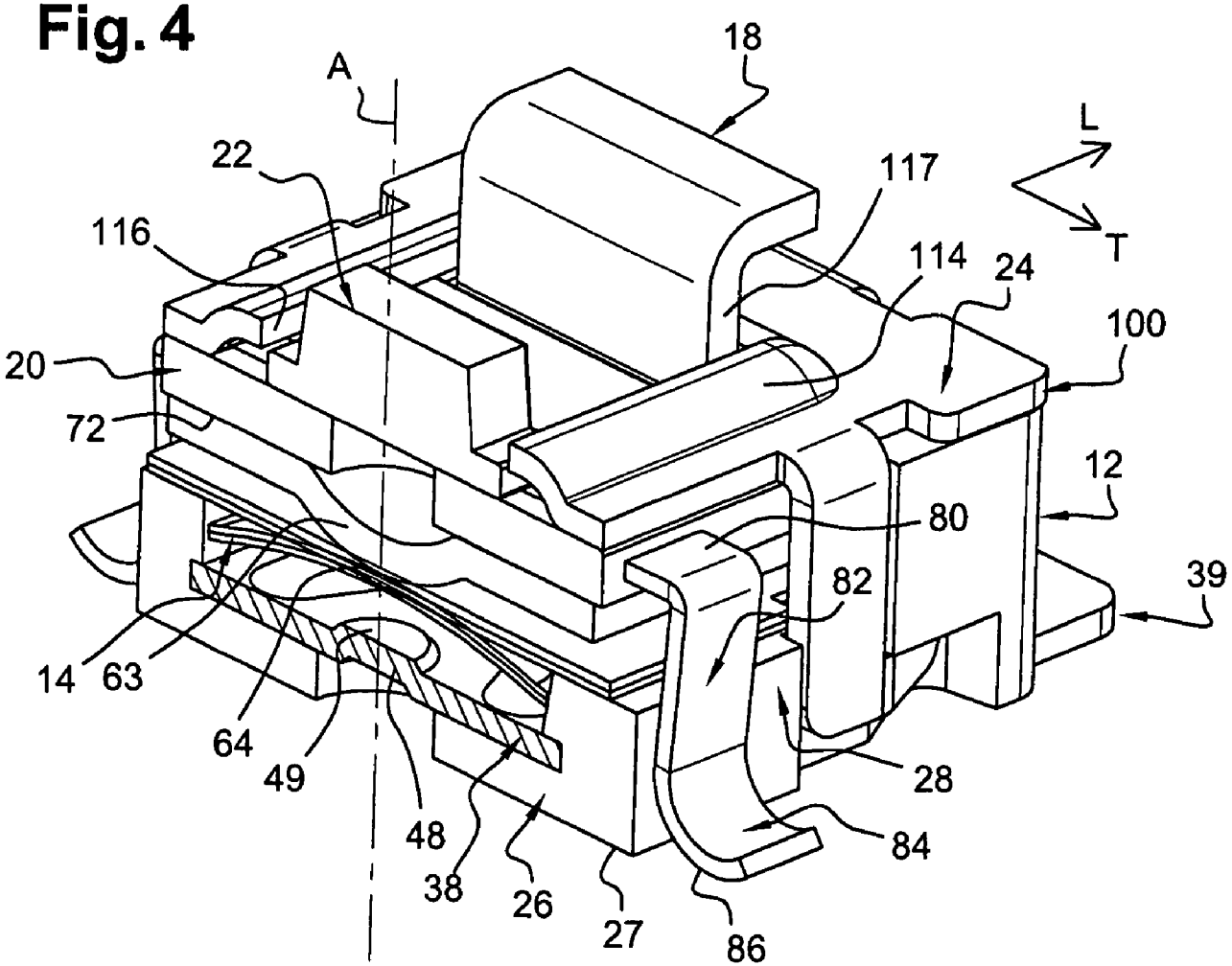
FIG. 4 is a view similar to that of FIG. 3 in which the connector is illustrated in section on the vertical transverse mid-plane (TMP) of FIG. 11.
Figure 5:
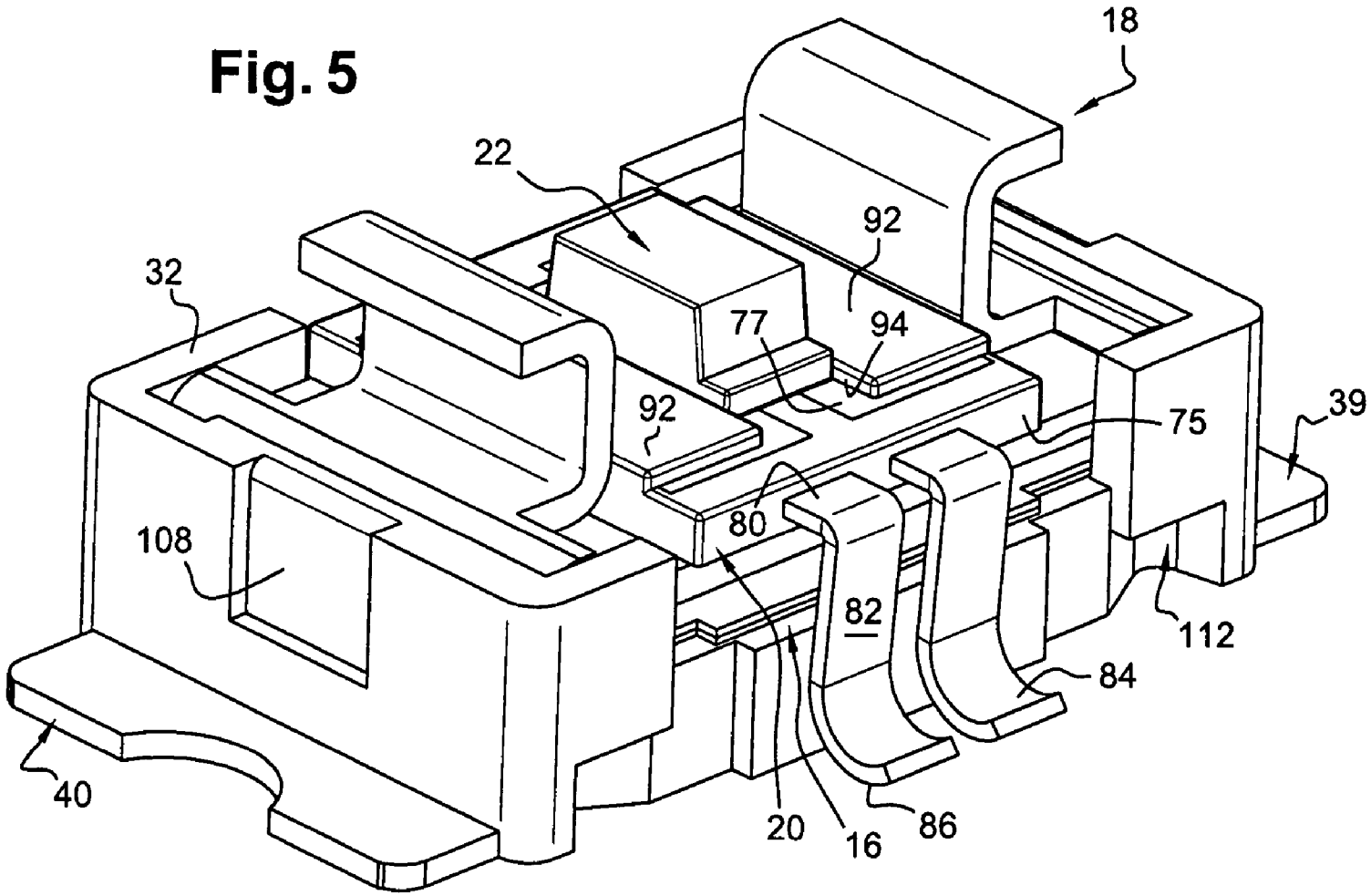
FIGS. 5 to 10 are views similar to those of FIG. 1, in which the various vertically stacked components of the switch have been progressively removed.

The outline and the dimensions of the two members are such that they are housed practically without any clearance, as may be seen in FIGS. 3 and 4, so as to bear vertically on the faces 42 and 44 and beneath the edge 50.

In their stable rest state, that is to say when they are not deformed, the members 14-52 rest via their lower rectangular bases 54 on the faces 42 and 44, and their central domes 52 are offset vertically upwards above the central disc 48, 49.

In the stable rest position of the trip members 14, these are permanently in electrical contact with the fixed lateral contact 36.

A central vertical downward action along the axis A on the superposed domes 52 causes, in a known manner, the sudden change of state of the members 14 in such a way that the domes 52 suddenly come into contact with the upper face 49 of the fixed central contact 38, 48 in order to establish an electrical connection between the fixed contacts 36 and 38 and therefore between the external electrical connection tabs 40 and 39.

The bottom housing of the lower casing 12, bounded upwards by the lower horizontal edge 50, in which housing the fixed contacts 36-42 and 38-48 and the trip members 14 are placed, is closed off in a sealed manner by two superposed sealing films 16, the periphery of which is for example adhesively bonded to the upper face of the lower horizontal edge 50.

The regions in which the fixed electrical contacts 36, 38 and moving electrical contacts 14-52 are placed are therefore entirely protected from moisture and contamination.

Figure 8:
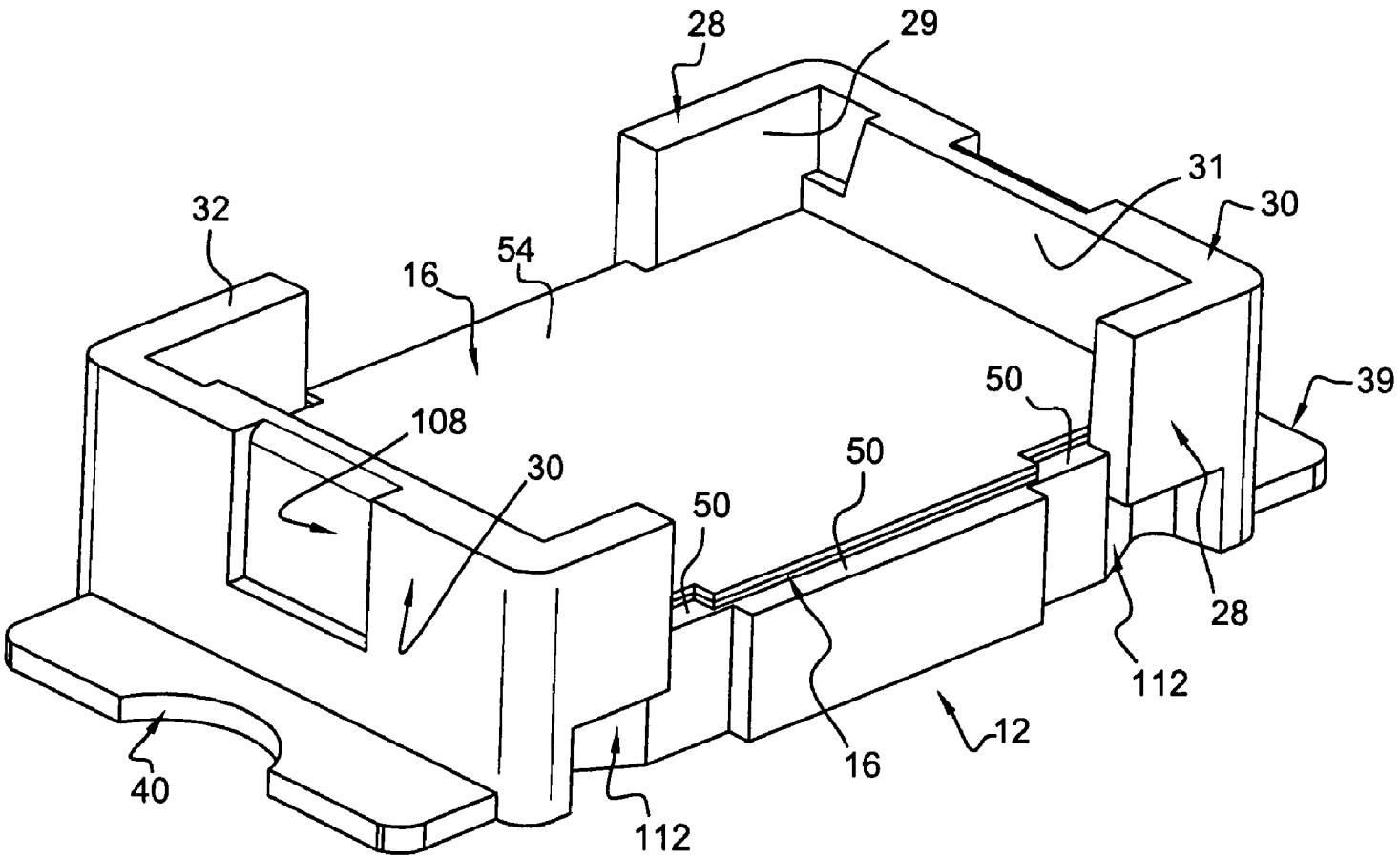
Figure 9:
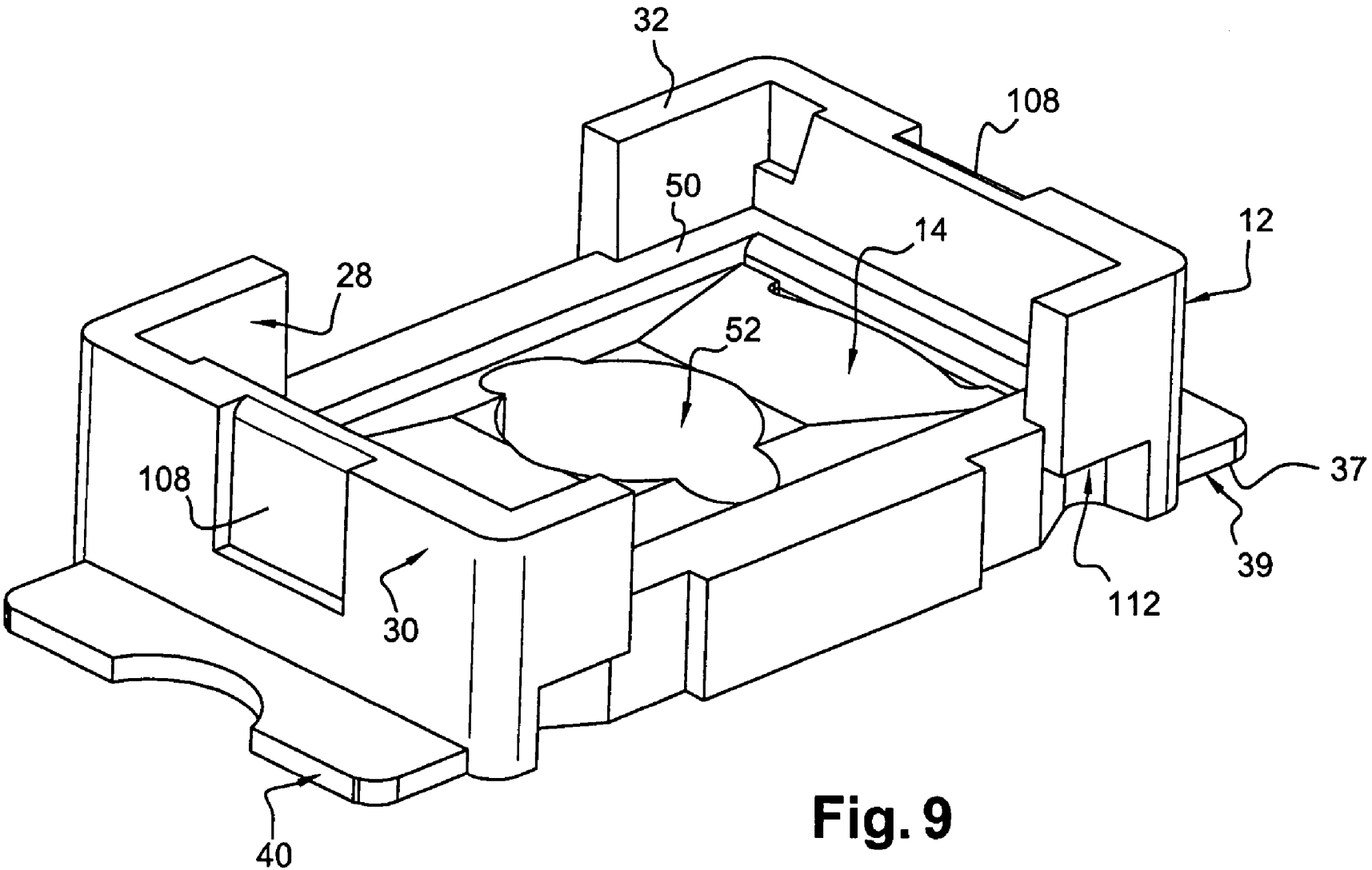

As may be seen in FIGS. 8 to 10, the longitudinal side walls 28 each have a central recess 56 which extends vertically from the plane of the edge 50 right up to the top and which is bounded by transverse vertical faces 58.

Beyond the horizontal upper face 54 of the upper film 16, the cavity 34 houses the actuating member or actuator 18.

The actuator 18 is a metal part made of thick sheet metal, produced by cutting and folding, which consists essentially of a lower horizontal actuating plate 60 having, at its center, a central actuating boss 63, the convex lower face 64 of which is centered on the axis A and bears, via the films 16, on the upper face of the superposed central domes 52.

At each of its opposed longitudinal ends, the lower actuating plate 60 of the actuator 18 is bent over through 180° in the manner of a hairpin, thus having two horizontal bent-over parts 62 that extend longitudinally inwards towards the axis A.

The longitudinal dimensions of the plate 60 with its bent-over parts 62 are such that it is housed practically without any clearance in the cavity 34 bounded by the internal faces 31 of the side walls 30.

The dimensions of the plate 60 with its bent-over parts 62 are such that the upper horizontal face 64 of the bent-over parts 62 is slightly offset upwards relative to the plane of the horizontal face or horizontal upper edge 32 of the moulded lower casing 12, this dimension being determined by the stack of the actuator 18, of the films 16 and of the actuating members 14 in the bottom of the casing 12.

Beyond the horizontal bent-over parts, the actuator 18 has two vertical central branches 66 of transverse orientation, each of which is bent back through 90° horizontally and longitudinally towards the outside so as to be extended by an upper horizontal branch 68, the branches 68 being coplanar with and bounded by two horizontal upper faces 70.

The horizontal branches 70 allow a translucent button (not shown) to be mounted and fixed, the design of the said button depending on the application in which the switch is used.

The support plate 20 is a plastic moulded part, this being a plate of substantially rectangular shape bounded by a plane lower horizontal face 72 so as firstly to constitute the closure plate of the cavity 34, in order to "imprison" therein the actuator 18, by extending horizontally above the horizontal upper face 61 of the lower plate 60 of the actuator 18.

For this purpose, the lower face 72 bears vertically downwards on the edge 50 with interposition of the lateral outline of the sealing films 16.

The dimension along the longitudinal direction separating the vertical transverse lateral faces 74 of the plate 20 is such that it is housed with longitudinal clearance between the facing internal faces 67 of the vertical branches 66 of the actuator 18 in such a way that the latter can move vertically downwards.

The stack of the components is such that, in the rest position, the trip members 14 are slightly prestressed vertically, exerting a vertically upward return force on the actuator 18, via the sealing films 16, in such a way that the upper face 61 of the actuating plate 60 bears vertically upwards against the upper face 72 of the plate 20.

Figure 17:
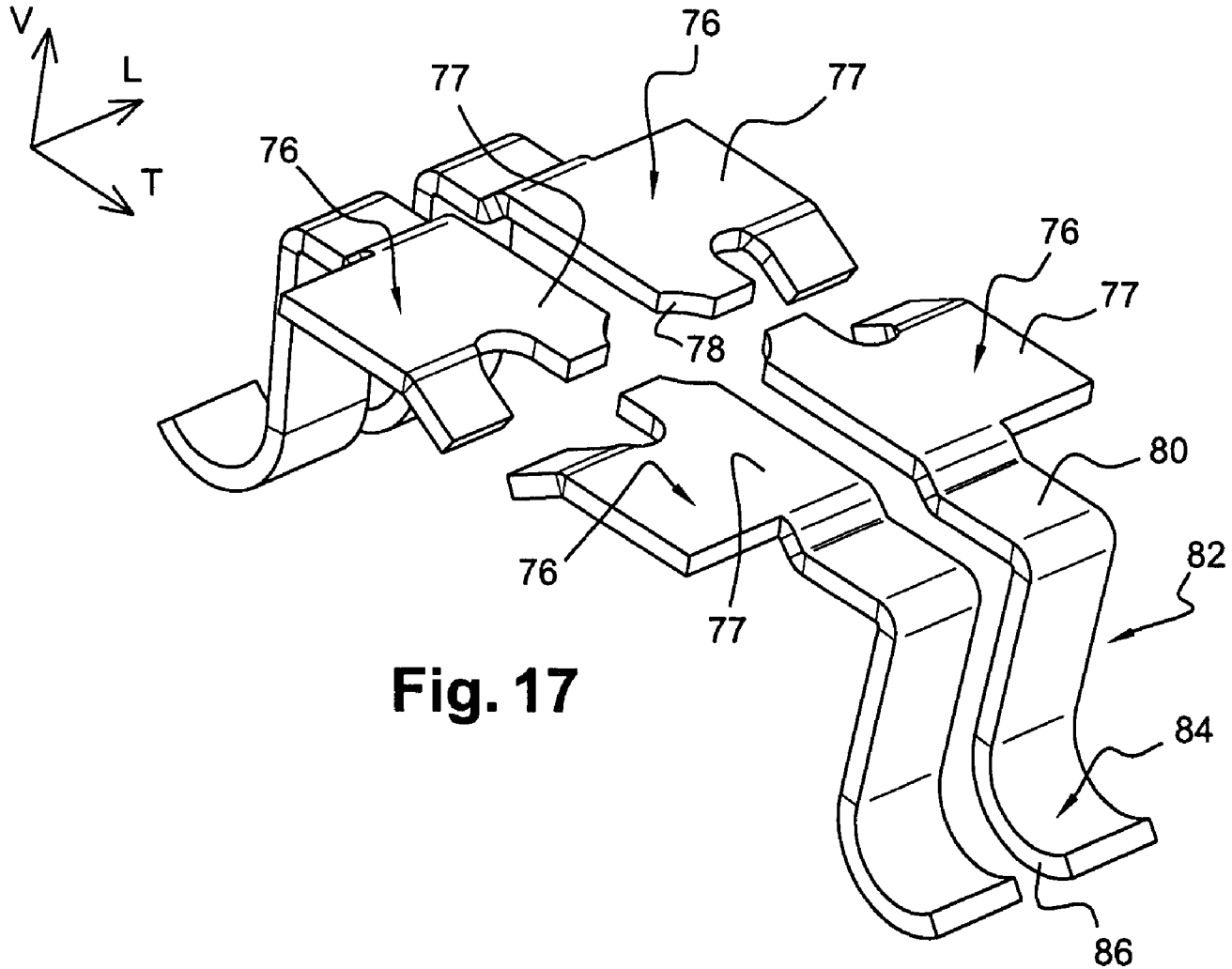
FIG. 17 is a top isometric view on a large scale of the four connection terminals, before overmoulding of the support plate.

The plate 20 is a moulded plastic part that is overmoulded here around four fixed contact elements 76, these being illustrated in greater detail in FIG. 17.

Each fixed contact element 76 is a small horizontal plate bounded by a horizontal upper contact face 77.

The four upper faces are coplanar and each small plate 76 belongs to an element made of cut and folded sheet metal.

The four fixed contacts 76 here are arranged in a square around the central axis A, each with a central circularly arcuate recess 78 defining a vertical cylindrically arcuate face.

Each fixed contact 76 is extended transversely outwards by a horizontal tab 80 vertically offset downwards relative to the plane of the small plates 76.

Each tab 80 is extended by a vertical branch 82 that lies in a longitudinal vertical plane and is itself extended by a curved lower end branch 84, with its lower convex face 86 oriented downwards so as to constitute, for each fixed contact 76, an electrical connection terminal.

In accordance with the teachings of the invention, the length of the horizontal tabs 80 that project transversely outwards beyond the longitudinal lateral faces 75 of the plate 20 is such that the electrical connection terminals 82-84 extend vertically outwards from the lower casing 12 and along the external faces of the longitudinal side walls 28 of the lower casing 12.

Figure 6:
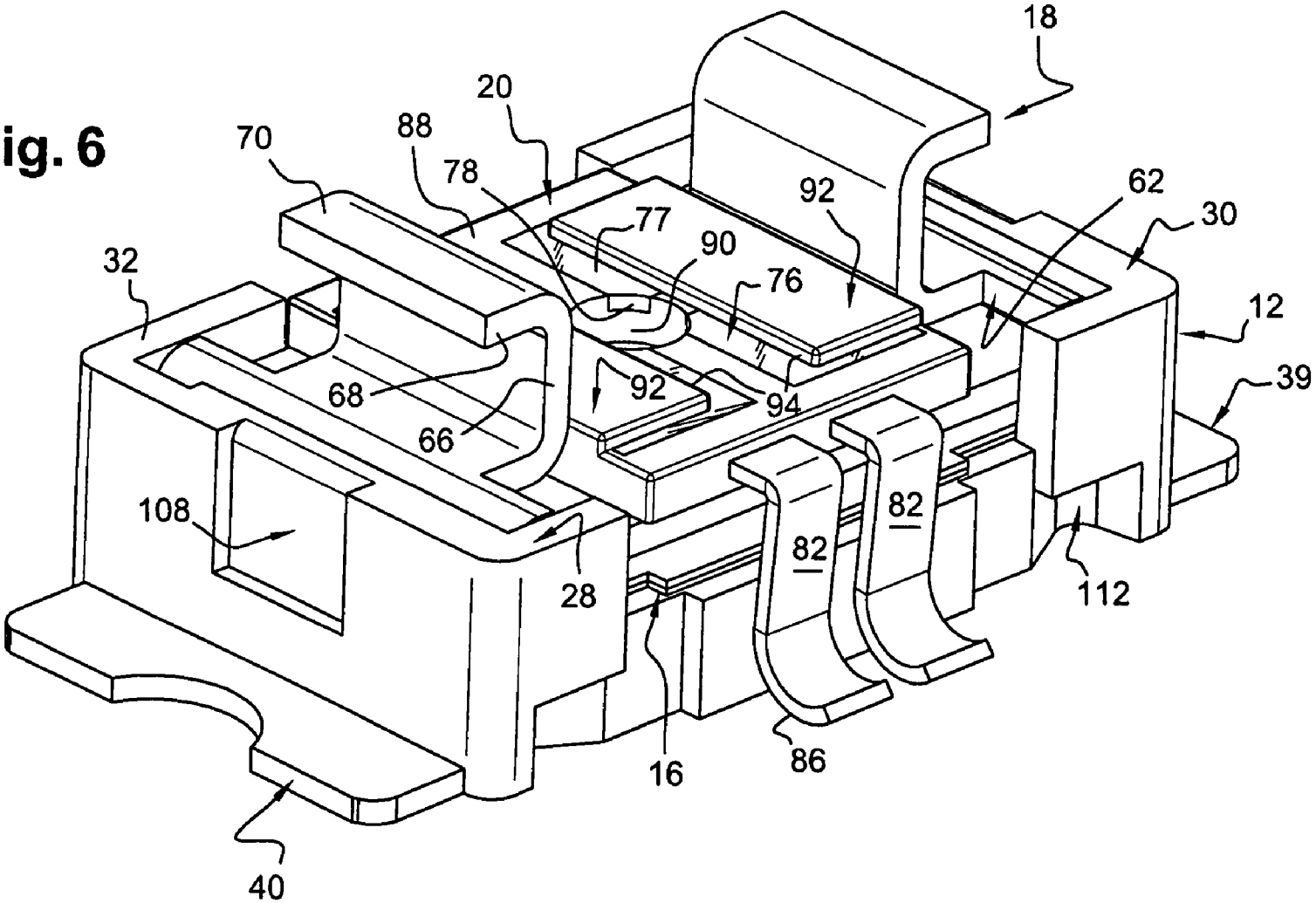
Figure 7:
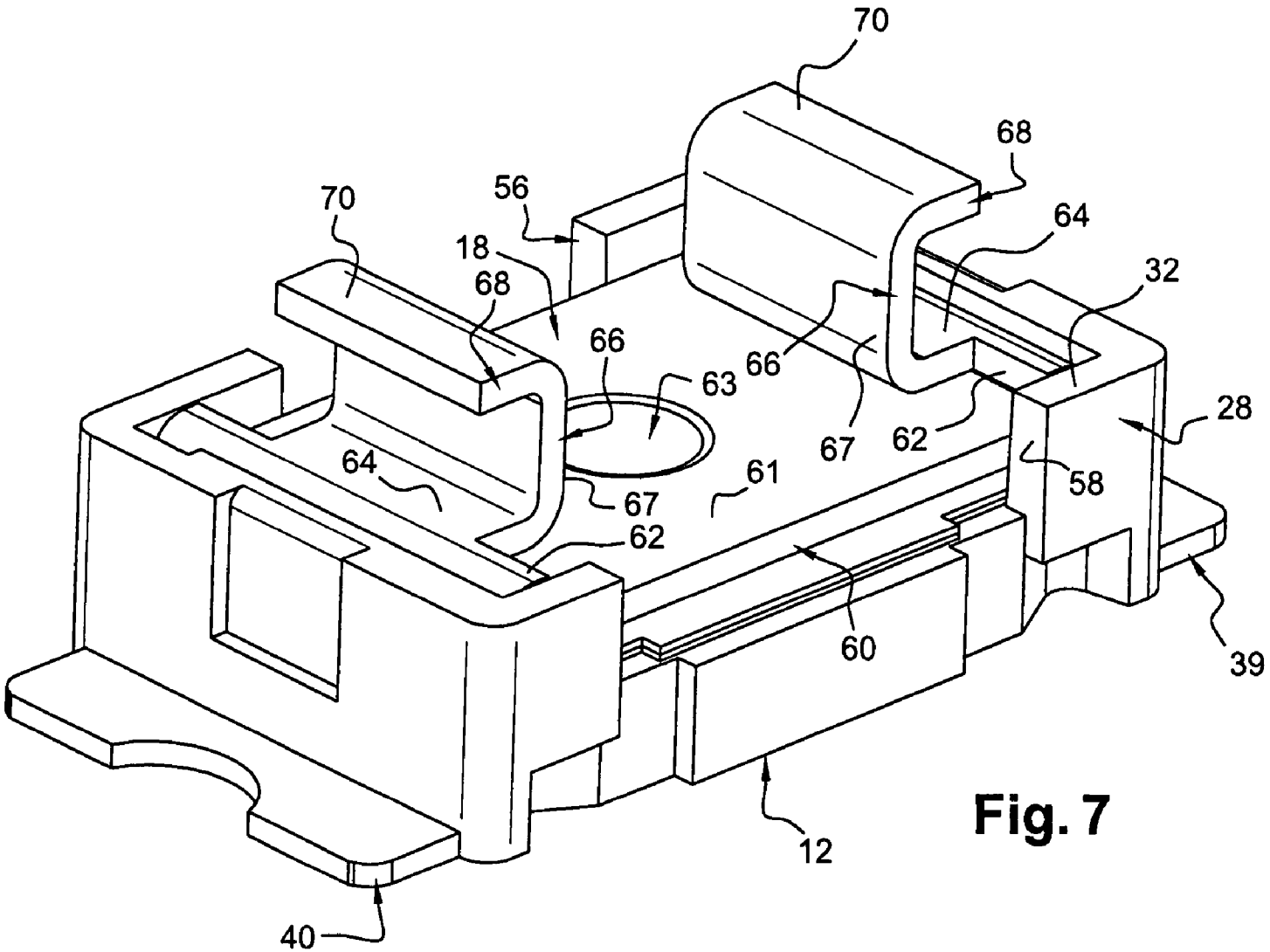

As may be seen especially in FIG. 6, the upper faces 77 of the four small fixed contact plates 76 are flush with the horizontal upper face 88 of the plate 20, the latter having, in the concave wall, a cylindrical central hole 90 with which the faces 78 are also flush owing to the separation of the four fixed contacts 76 after overmoulding of the body of the plate 20.

Finally, the plate 20 has two rectangular overthicknesses 92 that cover the rest of the upper faces 77 and define, by their opposed internal vertical transverse faces 94, a central housing intended to house the light source, which here consists of the diode or LED 22.

The latter is here of rectangular parallelepipedal general shape and has, in its lower horizontal face (not shown), electrical contact elements that bear on and are in electrical connection with the corresponding facing portions of the upper faces 77 of the small plates 76.

The LED 22 is fastened to the support plate 20 by, for example, soldering, brazing and/or bonding by means of a conductive adhesive.

The support plate 20 may also be overmoulded, at least partly, over the fixed contacts 76 and over the body of the diode 22.

The diode or LED 22 extends generally vertically above the support plate 20 between the branches 66 and 68 of the actuator 18.

Figure 15:
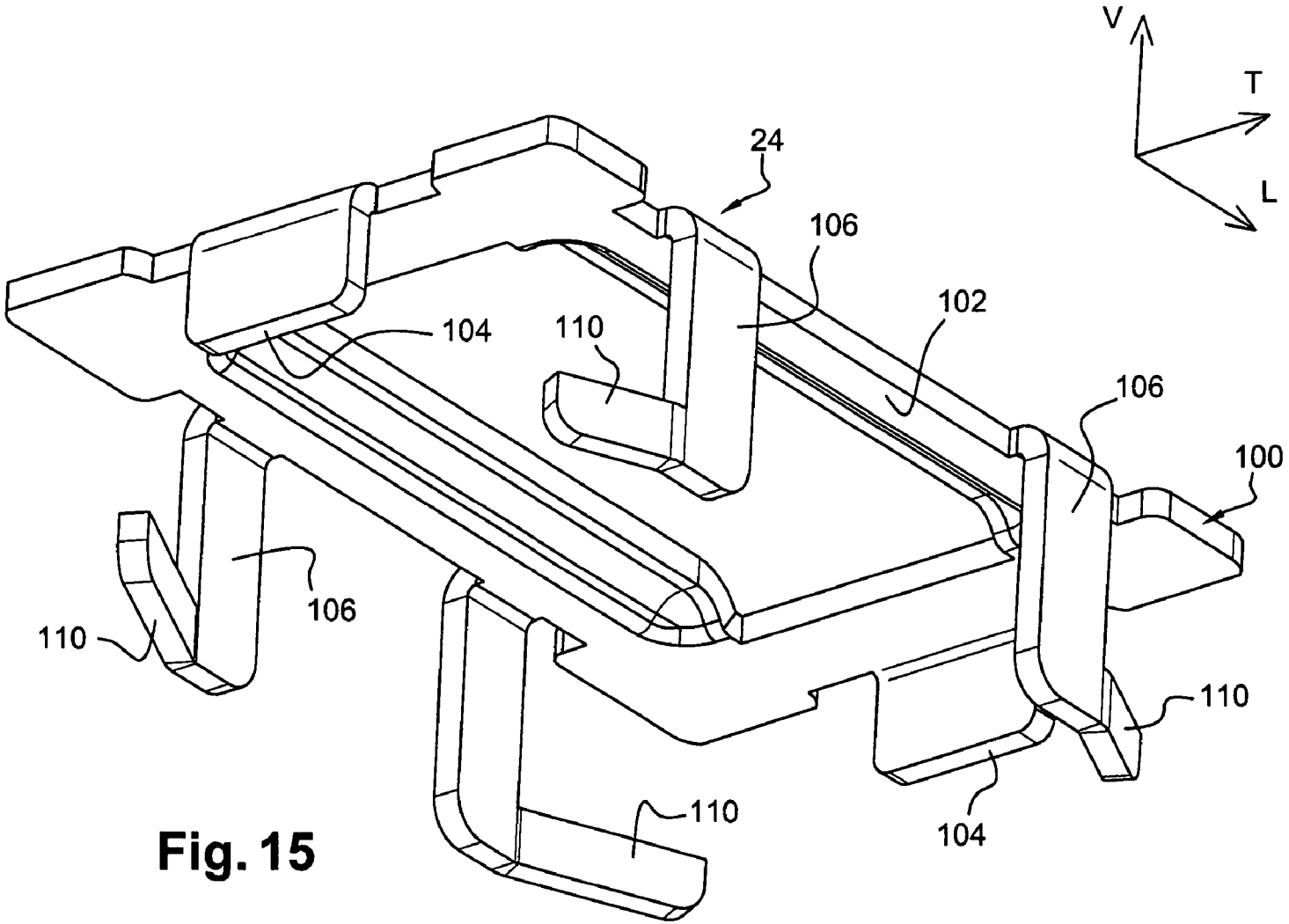
FIG. 15 is a bottom isometric view on a large scale of the cage of the switch.
Figure 16:
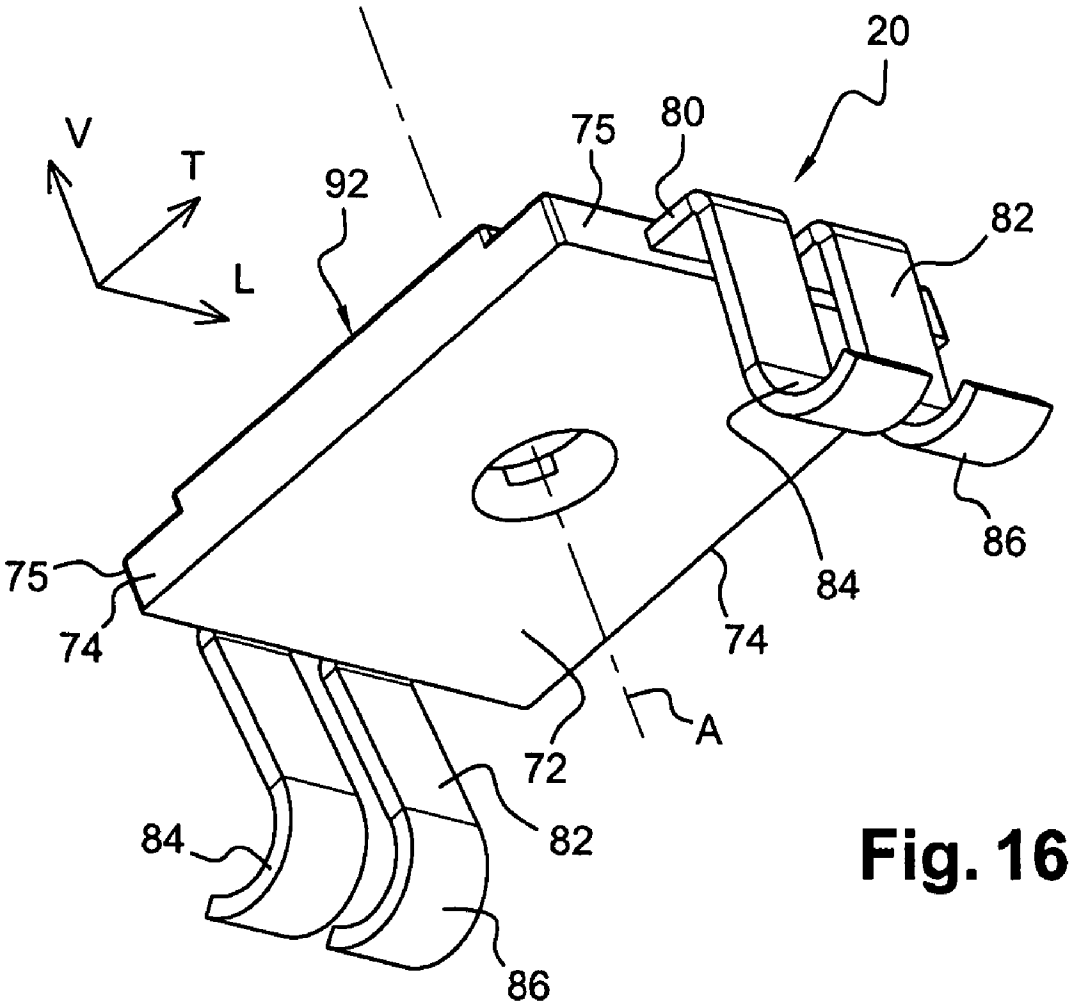
FIG. 16 is a bottom isometric view on a large scale of the support plate with its electrical connection terminals.

The support plate 20 is fastened by the upper cage 24, which therefore imprisons the other components in the lower casing 12, said cage being a part made of cut and folded sheet metal having in particular an upper closure frame 100 of rectangular flat outline bounded by a lower face 102 (see FIG. 15) which bears on the edge 32 of rectangular outline.

In order to position it relative to the lower casing 12 and more precisely relative to the upper edge 32, the closure frame 100 is extended downwards by two transverse vertical tabs 104, each of which is housed in a complementary housing 108 formed for this purpose, by moulding, in the external face of the associated transverse side wall 30.

The dimensions of the tabs 104 and of the housings 108 are such that the cage 24 is thus positioned practically without any clearance in the horizontal plane relative to the lower casing 12 on the upper face 32 of which it bears vertically via its frame 100-102.

In order for it to be fastened to the lower casing 12, so as to be prevented from moving vertically, the cage 24 is extended by four longitudinal vertical tabs 106, each of which, in order to limit the transverse extent of the switch, is housed in a recess 112 provided for this purpose in the outer face of the longitudinal side wall 28, also participating in the positioning of the cage 24 relative to the casing 12.

Each vertical fastening tab 106 is extended, at its lower end, by a crimp-fastening tab 110 that extends horizontally outwards in a substantially longitudinal direction and extends initially, that is to say before it is deformed by crimping, in the same vertical plane as the tab 106.

For the crimping, each lower plate 110 is deformed transversely inwards so as to be housed in a complementary recess 112 provided for this purpose and formed at the base of the lower casing 12 in the external face of the longitudinal side wall 28, which recess also emerges in the lower face 27 of the bottom plate.

The upper frame 100 is extended inwards beyond the edge 32 by two ribs 114 of longitudinal orientation and forming an overthickness, the vertical longitudinal faces 116 of which ribs extend opposite the vertical lateral faces 117 of the vertical branches 66 of the actuator 18.

The upper closure frame 100, with its face 102, thus provides the positioning and the vertically upward retention of the support plate 20 of the LED 22.

The support plate is thus sandwiched vertically between the casing 12 and the cage 24.

Figure 14:
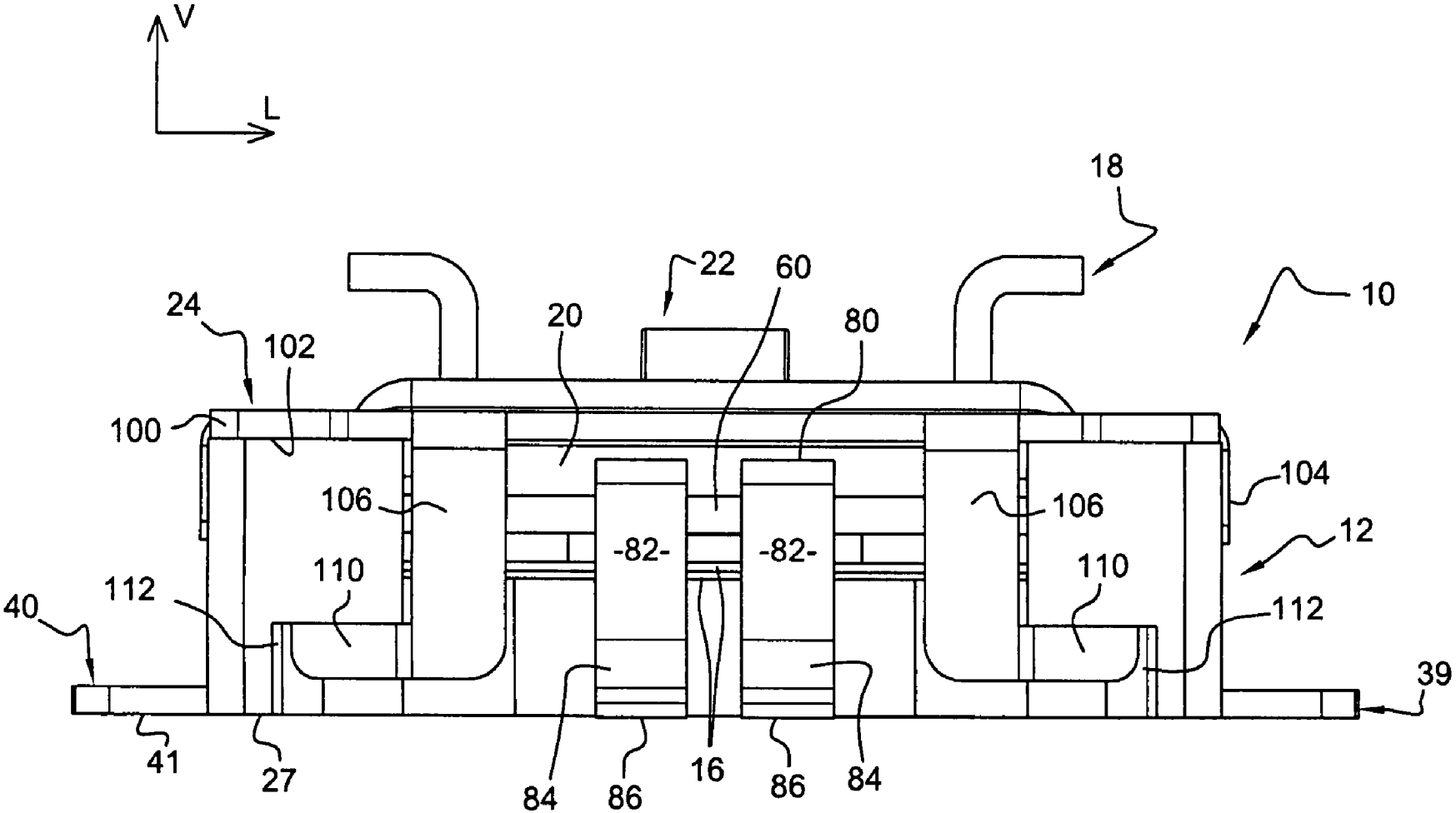
FIG. 14 is a side view of the switch of FIG. 1.

As may be seen especially in FIG. 14, the convex lower face 86 of each connection terminal 82-84 lies substantially in the plane of the lower face 27 of the lower casing 12, slightly offset below the latter.

Thus, when the switch 10 is fastened, by soldering or brazing, especially by reflow soldering, to the upper face of a printed-circuit board PCB (not shown) via the lower faces 41 and 37 of the connection tabs 40 and 39 of the fixed contacts, the terminals 84 are able to ensure electrical contact by elastic pressure on and/or via the soldering to the corresponding conducting tracks (not shown) of the printed-circuit board PCB.

Of course, the invention is not limited to the embodiment that has just been described.

For example, it is possible to provide one or more diodes 22 on the support plate 20, it being possible for the latter to have a larger number of electrical connection terminals depending on the number of diodes used.

What is claimed is:

1. An electrical switch having a tactile effect, which includes a lower casing having a lower face designed to rest on the upper face of a printed-circuit board, the lower casing having an internal cavity and at least two fixed electrical contact elements lying in a bottom of the cavity, each contact being connected to a connection tab that projects to the outside of the casing for the electrical connection of the fixed contact element to a conducting track on the printed-circuit board, a trip member of domed general shape which is housed in the cavity and is elastically deformable from a stable rest state under the action of an actuating member, wherein a lower part of the actuating member acts on the trip member along a direction approximately perpendicular to the bottom of the cavity, and at least one light source carried by a support plate which lies above the open upper face of the cavity, which straddles the actuating member and which includes terminals for electrical connection of the light source to a power supply circuit for the light source, wherein:

the electrical connection terminals of the light source extend to the outside of the casing and vertically along vertical lateral faces of the casing.

2. A switch according to claim 1, characterized in that the casing has two vertical, parallel and opposed, side walls, the upper edges of which each have an upwardly open recess configured to support a facing portion of the support plate.

3. A switch according to claim 2, characterized in that the switch includes an attached cage for fastening the support plate to the casing.

4. A switch according to claim 3, characterized in that the fastening cage is a metal cage comprising an upper closure frame that extends opposite the upper edges of the side walls of the casing and having vertical arms for fastening the frame to the casing.

5. A switch according to claim 4, characterized in that the closure frame bears vertically on the upper edges of the side walls of the casing.

6. A switch according to claim 4, characterized in that the upper closure frame provides positioning and upward vertical retention of the support plate.

7. A switch according to claim 1, characterized in that lower free ends of the electrical connection terminals of the light source are shaped so as to bear elastically on conducting tracks on the upper face of the printed-circuit board.

8. A switch according to claim 1, characterized in that the support plate delimits, vertically upward, a rest position of the trip member to which rest position the support plate elastically returns.

* * * * *